United States Patent [19]

Wallin

[11] 4,064,305

[45] Dec. 20, 1977

[54] KNITTED CAMOUFLAGE MATERIAL

[75] Inventor: Erik W. Wallin, Gamleby, Sweden

[73] Assignee: Barracudaverken AB, Sweden

[21] Appl. No.: 739,726

[22] Filed: Nov. 8, 1976

Related U.S. Application Data

[63] Continuation of Ser. No. 576,983, May 13, 1975, abandoned.

[51] Int. Cl.[2] ..... G01S 7/36

[52] U.S. Cl. ..... 428/246; 343/18 A; 428/197; 428/252; 428/253; 428/359; 428/364; 428/365; 428/379; 428/902; 428/919

[58] Field of Search ..... 428/224, 197, 919, 253, 428/252, 902, 255, 257, 246, 359, 364, 365, 379; 57/157 AS, 140 BY; 156/148; 343/18 A

[56] References Cited

U.S. PATENT DOCUMENTS

| | | | |
|---|---|---|---|
| 2,825,168 | 3/1958 | Ekman | 428/919 |
| 3,119,729 | 1/1964 | Ljungbo | 428/253 |
| 3,678,675 | 7/1972 | Klein | 57/140 BY |
| 3,723,234 | 3/1973 | MacDonald | 428/253 |
| 3,733,606 | 5/1973 | Johansson | 428/919 |

*Primary Examiner*—James J. Bell

*Attorney, Agent, or Firm*—Roylance, Abrams, Berdo & Kaul

[57] ABSTRACT

A base fabric for a radar defeating camouflage material comprising a knitted fabric knitted from a plurality of strands to form a stretchable, flexible fabric having a plurality of openings therethrough, each of these strands constituting a spun mixture of noncontinuous polymeric fibers and noncontinuous metal or carbon fibers. The fibers can be nylon or polyester. The metal fibers can be stainless steel. The metal or carbon fibers can comprise about 2 – 10 percent by weight of the spun yarn, the fibers having an average diameter between about 0.008 and 0.02 millimeters and an average length between about 50 millimeters and 90 millimeters.

7 Claims, 8 Drawing Figures

KNITTED CAMOUFLAGE MATERIAL

This is a continuation of application Ser. No. 576,983, filed May 13, 1975 now abandoned.

This invention relates to camouflage material and to a fabric useful in making such material.

In the military circumstances of today, there is a continuing need for camouflage which has several rather specific requirements, depending upon the use to which it will be put. The older and more obvious requirements are that the camouflage must be capable of presenting a visual appearance similar to the surroundings, i.e., it must look like snow when it is designed for use in the Arctic or it must look like soil or vegetation or some combination thereof, when it is to be used to conceal an object in a woodland environment. It must also be flexible so that it can be draped over an object, with or without a support framework, and it must be light enough in weight so that it can be easily handled by one or a few individuals and placed in the desired location.

As the art of making camouflage has improved, so have the techniques of detecting deployed camouflage. Thus, it is now desirable to provide camouflage which has infrared and ultraviolet reflectance characteristics similar to the environment, in addition to the visual characteristics. Also, for many applications, it must present an impedance to electromagnetic energies similar to the environment, thereby to avoid detection by radar. If the camouflage has all of these characteristics, it is possible to avoid detection by infrared or ultraviolet photography or by optical observation devices, or by radar.

In the prior art efforts to provide camouflage meeting these, and other, requirements, it has become customary to coat or laminate a base material with at least one pigmented coating layer, usually on both sides of the base material, the coating layer or layers being designed to provide the desired optical characteristics (visual, infrared and ultraviolet). The base material is usually a fibrous web with a multiplicity of tiny metal or graphite fibrils secured thereto, generally on one surface of the web. The fibrous web is typically 0.1 – 0.25 millimeters thick and comprises a non-woven web of fibers of a thermoplastic polymeric material, the fibers being fusion-bonded, fiber-to-fiber, to establish a stable fabric. A commonly used fabric of this type is a "spun-bonded nylon" of the type marketed by Monsanto Chemical Company, St. Louis, Mo., under the trademark CEREX.

While camouflage material of both radar defeating and radar transparent types have been successfully produced with this combination of materials, certain shortcomings have become apparent. One of these is the strength of the material. The substrate web, e.g., CEREX, because of the manner in which it is made, has less strength than desired. Thus, one must rely upon a supporting net to a considerable degree to maintain the integrity of the camouflage material itself.

Still further, it has been found necessary to take special steps in coating the base material in order to provide the necessary bonding strength between layers and to, simultaneously, provide the desired optical characteristics. While thicker coatings can be applied to attain these characteristics, the thicker coatings add considerably to the total weight of the material. Thus, presently manufactured camouflage material, while reasonably satisfactory, constitutes a compromise between characteristics and does not constitute an optimum configuration.

A further, and somewhat more significant, problem with the prior art material of this type has to do with the radar defeating properties thereof. It has been found that with camouflage material produced using a base material comprising metal fiber-garnished CEREX, the radar characteristics are changed when the fabric is folded or handled in a manner which causes the material to be bent in a short radius. While the original radar characteristics of the material might be suitable when it is first manufactured, after folding and use in the field, the radar characteristics change along the folds in such a way that it is no longer capable of presenting radar absorption and reflectance characteristics like the surrounding environment.

Accordingly, it is an object of the present invention to provide a base fabric for camouflage material which can be made with good radar reflectance characteristics.

A further object is to provide a camouflage material which has coatings of minimal thickness and, therefore, minimum weight.

A further object is to provide a camouflage material which has good self-supporting strength and which can be laminated or coated to arrive at the desired optical reflectance characteristics.

Yet another object is to provide a camouflage material which has good radar reflectance characteristics and which can be folded and otherwise handled without degradation of those radar characteristics.

Broadly described, the invention includes a base fabric for a camouflage material comprising a plurality of strands of spun yarn knitted together to form a stretchable, flexible and substantially planar fabric having a plurality of openings therethrough, each of the strands comprising a spun mixture of polymeric fibers and metal or carbon fibers. The invention further contemplates a camouflage material including such base fabric and further including a first flexible film covering and adhered to one side of the base fabric and a second flexible film covering and adhered to the other surface of the fabric, the first and second films being adhered to each other through the openings in the fabric. The polymeric fibers can be, for example, nylon and the metal fibers stainless steel. The stainless steel fibers can constitute about 2 to 10 percent of the spun yarn, by weight, the stainless steel fibers having a diameter between about 0.008 millimeters and about 0.02 millimeters and an average length between about 50 millimeters and about 90 millimeters, the preferred range of lengths being between about 60 millimeters and about 80 millimeters.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
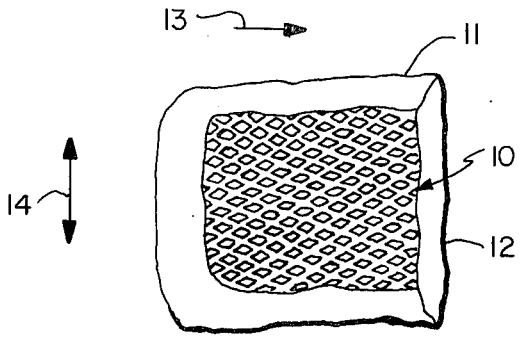
FIG. 1 is a plan view of a knitted base fabric in accordance with the invention.

FIG. 1 shows a fragment of camouflage material made in accordance with the present invention with a portion of the coating removed so that the base fabric arrangement can be seen. As shown therein, the material includes a base fabric 10 having a coating or layer 11 on one side thereof and a coating or layer 12 on the other side thereof, forming a laminated material having unique properties. The base fabric 10 is a knitted material made from thread or yarn strands which are spun from relatively short noncontinuous fibers of a nylon nature such as polyamide 6—6 and noncontinuous electrically conductive metal or carbon fibers, which are treated in the spinning process like the nylon fibers and are spun into the yarn along with the nylon. It is preferred that the conductive fibers be stainless steel and these fibers will be referred to as such hereinafter. The stainless steel fibers can have a diameter of between about 8 microns (0.008 millimeters) and about 20 microns (0.02 millimeters) and an average length between about 50 millimeters and about 90 millimeters, these fibers being formed by chopping a long length of drawn stainless steel wires into the desired length. For the manufacture of camouflage material to defeat radars presently in use, it is preferred that the average length of the stainless steel fibers be between about 60 millimeters and about 80 millimeters. The spun yarn is equivalent to about the metric number Nm 54, and is in the order of 0.05 to 0.1 millimeters thick. It will be recognized that the conductive fibers are distributed throughout the yarn and are not generally in contact with each other.

The yarn thus spun is knitted in a pattern which permits the resulting fabric to be flexible and stretchable, the pattern shown in FIG. 1 being one in which the diamond-shaped openings are six-sided and can therefore be referred to as hexagonal, although the hexagons are not regular, the dimension along the length of the fabric, i.e., in the direction of arrow 13 being greater than the transverse dimension, the latter being indicated by double-headed arrow 14. Because of this specific opening shape, the fabric is more stretchable in the direction of arrow 14 than in the direction of arrow 13. In this pattern, the openings constitute more than 50 percent of the total surface area of a major surface of the resulting fabric.

After the knitting process, the fabric is shaped by a stenter, or tenter, frame process in which the fabric is held along the selvages in the desired shape by a plurality of clips or small needles while it is passed through an oven. In this process, the fabric assumes a shape which is determined by the stretch imparted to it when it is held in the tenter frame and heated. After the heating process a memory characteristic is imparted thereto so that the opening shape, when relaxed, is close to that which existed on the tenter frame.

After the fabric has been knitted and shaped in accordance with the foregoing, one or more layers or coatings can be applied thereto. Coatings 11 and 12 can be sequentially applied by placing the knitted fabric on a backing release material and passing the fabric and release web through an apparatus for casting a film onto the fabric. Any conventional applying technique can be employed, such as a doctor blade or reverse printing technique, by which the film material is smoothly and uniformly applied to the knitted material. The films can be in a plastisol form, such as a plastisol of polyvinyl chloride, after which the films are cured by passing the web through a suitable curing oven.

Alternatively, films 11 and 12 can be separately formed and then combined with the knitted fabric. In this case, films 11 and 12 can individually be formed from polyvinyl chloride cast from a plastisol directly onto a release web and thermally cured on the web. The films thus formed are laminated onto the opposite major surfaces of fabric 10 by thermal bonding. This is accomplished by running the polyvinyl chloride films, still carried by their respective release webs, into flush engagement with fabric 10 and applying sufficient heat to bring the polyvinyl chloride to the fusion point and sufficient pressure to assure a uniform bond. The laminate is then cooled and the release webs are stripped from the exterior surfaces of the polyvinyl chloride films.

It will be observed that because of the relatively large area of the openings in the knitted fabric, the polyvinyl chloride films can be pressed through the openings to contact each other between the strands of the knitted material, thereby causing the two layers to adhere to each other, forming a unitary structure which has substantially greater resistance to delamination than a structure in which the web itself is relatively solid and nonporous, such as a spun-bonded fiber material in the nature of CEREX.

Films 11 and 12 can be of any thermoplastic polymeric material which can be converted into a self-supporting film of a thickness in the range of 0.03 – 0.07 millimeters, with the film being adequately flexible to retain its integrity under conditions of camouflage use over a wide range of temperatures. Polyvinyl chloride is particularly advantageous because it can be cast from a plastisol into a film of precisely controlled thickness and can be compounded with plasticizers suitable for low temperature conditions. Other suitable polymeric materials include polyvinyl acetate, dispersion grade acrylates, including polyethyl acrylate and polymethyl methacrylate and polyurethane.

The films 11 and 12 would normally be provided with pigment materials, the specific nature of and color of the selected pigment to be determined by intended usage for the camouflage material. The major purposes of the pigment content are to conceal the fabric 10 and to provide surface reflectance characteristics in the visible and near visible electromagnetic spectrum which resemble the environmental backgrounds in which the camouflage material is to be used.

Before continuing with a discussion of the base fabric and camouflage material in accordance with the invention, a discussion of the radar characteristics which are desired in camouflage material of the radar scattering type will be helpful. As previously indicated, a function of radar defeating camouflage material is to provide a reflectance characteristic which looks, to radar transmitting and receiving equipment, as much like the surrounding environment as possible. While a complete discussion of all of the characteristics, and reasons therefor, is neither necessary or desirable in the present context, some characteristics should be considered.

One characteristic has to do with the reflectance of the material. By standard U.S. Army test procedures currently in effect, the material is to present a radar reflectance of 40 percent based on a metal plate of the same area, and a one-way transmission attenuation of 6 – 7 decibels. Provision of the metal fibrils in the yarn strands, a previously described, and as will be described in greater detail, accomplishes this end when the metal fibers constitute about 2 – 10 percent of the fibers in the yarn, by weight.

Another characteristic has to do with the polarization reflectance and transmission characteristic of the material. If metal fibers were laid on the surface of a material in a uniform orientation, such fibers would act very much like a large number of small dipoles and would exhibit transmission and reflectance characteristics having a very specific pattern. Most radar systems involve the transmission of electromagnetic energy having a specific polarization, and it is possible to alter the polarization as by rotation thereof so that the radar can be used to irradiate the camouflage material with incident energy having a polarization parallel to the dipoles and then to irradiate the material with incident energy having a different polarization, e.g., rotated 90° from the first incident energy. In the example of metal fibers which are all aligned in parallel orientation, it will be readily apparent that the reflectance characteristics resulting from incident energy at 0° and then at 90° would be very different from each other, a difference which would be readily detectable by radar analysis.

Incorporating fibers in a yarn and then knitting this yarn into a material such as that shown in FIG. 1 results in the provision of fibers having various angular relationships to each other. These angular relationships, while not completely random, nevertheless represent an array which is significantly different from aligned dipoles and the reflectance characteristics are somewhat more in the direction of being "isotropic" than such parallel oriented dipoles.

Figure 2:
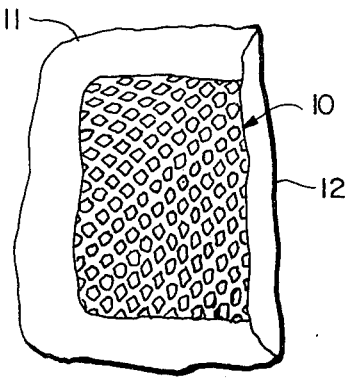
FIG. 2 is a plan view of the fabric of FIG. 1 shown stretched.

Of perhaps greater significance, however, is the fact that with a stretchable knitted fabric the isotropic characteristics of the fabric can be changed simply by stretching the material so that it arrives at a new pattern, slightly different from the original pattern in the relaxed state as shown in FIG. 1. A stretched fabric is shown in FIG. 2, this being a representation of the same fabric shown in FIG. 1 but with a stretch imparted to it so that the openings through the fabric are nearly regular hexagons. This stretch can be imparted to the material by stretching after the tenter frame process and can be "frozen" in the desired relationship by laminating the fabric between the polyvinyl chloride webs 11 and 12, as previously described. Once fixed in this relationship, the material continues to exhibit the same properties thereafter and can be relied upon to have the desired isotropic characteristics.

Figure 3:
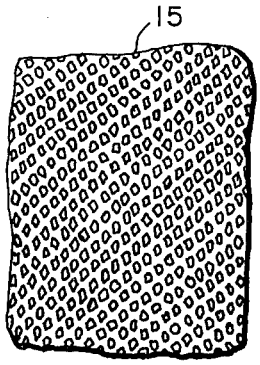
FIG. 3 is a plan view of the knitted base fabric with a different set in accordance with the invention.
Figure 4:
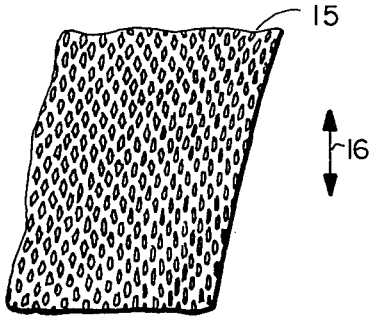
FIG. 4 is a plan view of the fabric of FIG. 3, shown in stretched condition.

FIGS. 3 and 4 illustrate a similar fabric having the same knit pattern but having openings of different proportions as a result of the application of a different degree of tension during the tenter frame process. FIG. 3 shows the material 15 in the relaxed state and FIG. 4 shows the material 15 stretched in the direction of arrows 16. It will be observed that arrows 16 represent the longitudinal direction of the web and that in the specific examples shown herein the web is being stretched in this direction. The openings under these circumstances become more similar to the openings shown in FIG. 1. The purpose of these illustrations is to demonstrate the fact that the stretchable material, once produced, can be adjusted to obtain a wide range of desired radar reflectance characteristics, depending upon the specific use to which it is to be put and depending upon the specific specifications to be met by the material.

Figure 6:
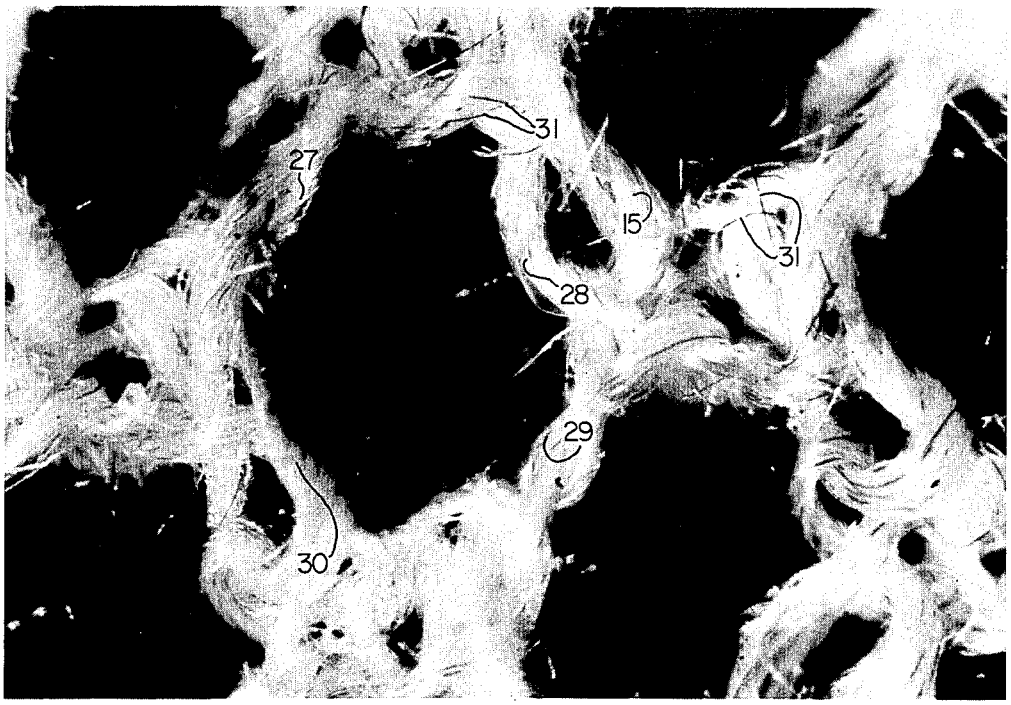
FIG. 6 is a photographic reproduction of the fabric of FIG. 3, enlarged.
Figure 5:
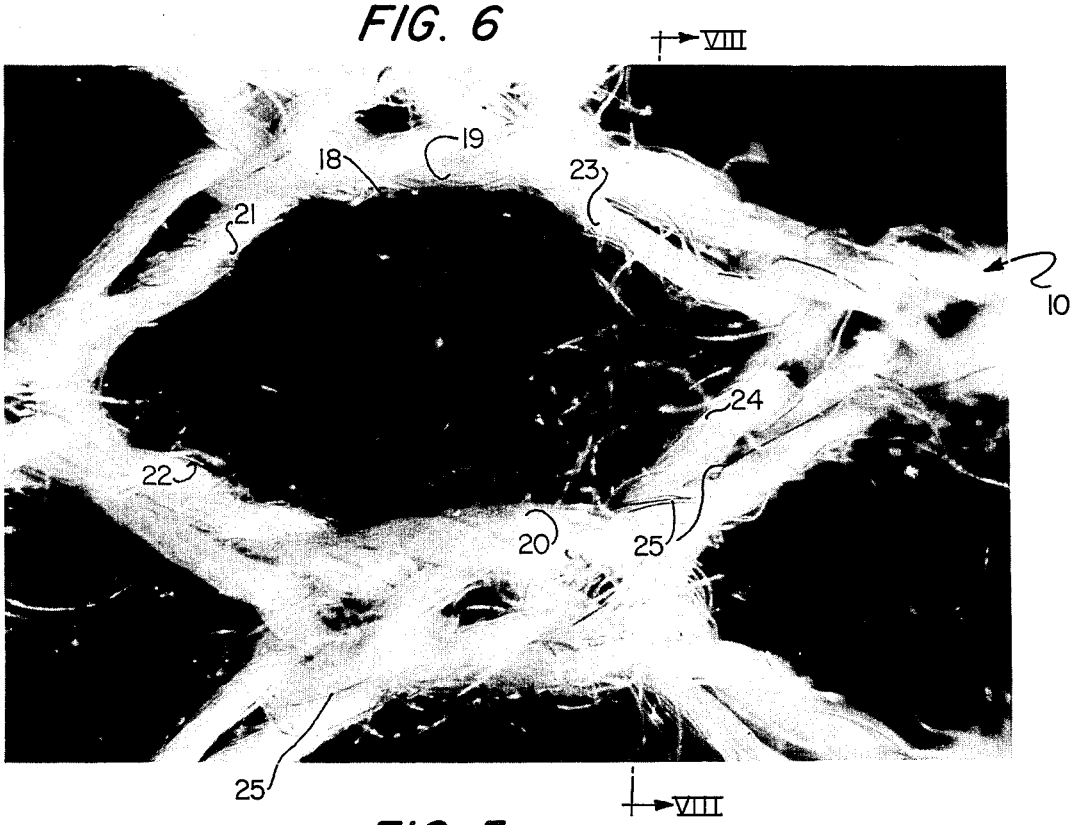
FIG. 5 is a photographic reproduction of a small portion of the fabric of FIG. 1, enlarged.

A more detailed view of the fabrics shown in FIGS. 1–4 can be seen by reference to the microscope photographs shown in FIGS. 5 and 6. FIG. 5 illustrates the fabric 10 of FIG. 1, showing one entire opening therethrough and a small amount of the surrounding fabric. As will be seen, the opening 18 is bounded by two substantially parallel sides 19 and 20, and four sloping sides 21, 22, 23 and 24, each of the sloping sides having three strands which interengage in parallel sides 19 and 20. It will further be seen that the yarn includes a plurality of metal fibers 25, only a few of which are specifically identified in the photograph. As previously stated, these fibers are spun into the yarn before it is knitted into the fabric. In the specific example illustrated in FIGS. 5 and 6, the metal fibers are stainless steel and comprise about 7 percent, by weight, of the spun yarn. Each stainless steel fiber in this specific yarn is approximately 8 microns in diameter. The fibers having been formed from stainless steel wire chopped into lengths which average about 70 millimeters. The nonconductive threads in the yarn comprise nylon thread in short lengths, on the same order of magnitude as the stainless steel fibers, the length of the nylon sections being of little criticality, the important aspect being that it is not continuous filament.

As seen in FIG. 5, the opening through the knitted fabric is approximately diamond-shaped with the angles between portions 21 and 22 and between portions 23 and 24 being on the order of 50° – 60°. The fabric thickness is on the order of 0.010 – 0.015 inches (0.25 – 0.38 millimeters).

The fabric 15 of FIGS. 3 and 4 is shown in greater detail in the photograph of FIG. 6, this fabric differing in that it has been stretched during tentering so that it appears to have relatively shorter side portions than the fabric of FIG. 5. Specifically, the fabric of FIG. 6 has legs 27, 28, 29 and 30 defining the boundaries of a single opening through the net, these legs meeting at approximately right angles at their junctures. The fabric of FIG. 6 is shown in the relaxed state (i.e., not stretched after tentering). The yarn and knit pattern used to make this fabric is the same as that of FIG. 5 and incorporates the same metal fibrils.

Figure 7:
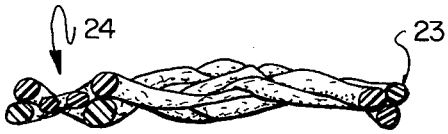
FIG. 7 is an elevation in section, of the fabric of FIG. 5 along lines VII—VII thereof.
Figure 8:
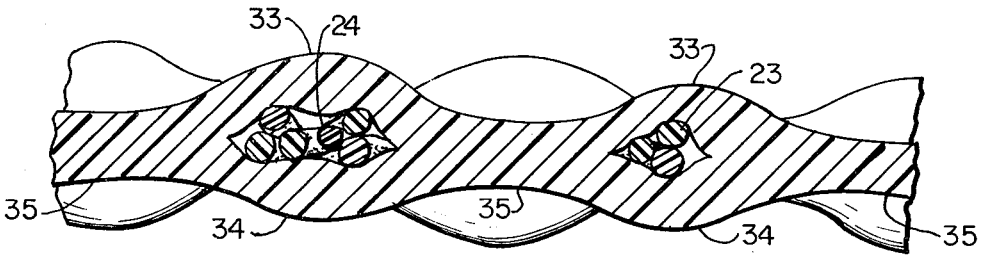
FIG. 8 is an elevation, in section, of the base fabric of FIG. 7 with coatings applied thereto.

The fabrics shown in FIGS. 5 and 6, are, of course, shown without coatings thereon. FIG. 7 shows a section along lines VIII—VIII of FIG. 5 depicting the material of FIG. 5 and showing the interrelationship of the strands, as well as can be depicted in a section of a fabric of this type. The fabric thus depicted is also, of course, without coatings. FIG. 8 illustrates a section along lines VIII—VIII of FIG. 5, but with the coating applied thereto. As seen therein, the leg 23 and leg 24 include three and six strands respectively, the strands having the steel fibrils therein, these not being separately illustrated in FIG. 8.

The coating layers applied to opposite sides of this fabric form separate layers 33 and 34 on opposite sides of the strand bundles which form the legs of the knitted fabric, but that these layers merge and form essentially a single layer at the regions identified as 35 between these legs in the openings through the knitted fabric. Thus, a unitary sheet of material results, this sheet having good strength and resistance to separation.

While certain advantageous embodiments have been chosen to illustrate the invention, it will be understood by those skilled in the art that various changes and modifications can be made therein without departing from the scope of the invention as defined in the appended claims.

What is claimed is:

1. An improved radar-defeating, flexible camouflage material comprising a base fabric comprising a plurality of strands of spun yarn knitted together to form a stretchable, flexible, substantially planar fabric having a plurality of openings therethrough, each of said strands comprising a spun mixture of polymeric fibers and noncontinuous electrically conductive fibers with said conductive fibers comprising about 2 to 10 percent of the spun yarn, by weight to cause said base fabric to exhibit radar reflectance characteristics similar to its natural surrounding environment;

a first flexible film covering and adhered to one surface of said fabric, and a second flexible film covering and adhered to the other surface of said fabric, said first and second films being adhered to each other through said openings in said fabric.

2. A camouflage according to claim 1 wherein said polymeric fibers are nylon.

3. A camouflage material according to claim 1 wherein said electrically conductive fibers are stainless steel fibers each having a diameter of about 0.008 millimeters and an average length between about 60 millimeters and about 80 millimeters.

4. A camouflage material according to claim 1 wherein said electrically conductive fibers are fibers of elemental carbon.

5. A camouflage material according to claim 1 wherein said first and second flexible films comprise polyvinyl chloride.

6. A camouflage material according to claim 5 wherein said first and second flexible films further comprise a pigment.

7. A fabric according to claim 1 wherein said polymeric fibers are polyamide.

* * * * *